US010486891B2

(12) United States Patent
Wolak et al.

(10) Patent No.: US 10,486,891 B2
(45) Date of Patent: Nov. 26, 2019

(54) PLASTIC BOTTLE FOR A PRESSURIZED DISPENSING SYSTEM

(71) Applicant: S.C. Johnson & Son, Inc., Racine, WI (US)

(72) Inventors: Christopher P. Wolak, Racine, WI (US); Niles Stenmark, Franklin, WI (US); Kimberly J. Harris, Milwaukee, WI (US); Rodney L. Prater, Oak Creek, WI (US); Daniel S. McGrath, Gurnee, IL (US)

(73) Assignee: S.C. JOHNSON & SON, INC., Racine, WI (US)

( * ) Notice: Subject to any disclaimer, the term of this patent is extended or adjusted under 35 U.S.C. 154(b) by 321 days.

(21) Appl. No.: 15/367,678

(22) Filed: Dec. 2, 2016

(65) Prior Publication Data

US 2018/0155113 A1 Jun. 7, 2018

(51) Int. Cl.

| | |
|---|---|
| ***B65D 83/38*** | (2006.01) |
| ***B65D 83/14*** | (2006.01) |
| ***B65D 1/02*** | (2006.01) |

(52) U.S. Cl.

CPC ..... *B65D 83/38* (2013.01); *B65D 1/0261* (2013.01); *B65D 83/14* (2013.01)

(58) Field of Classification Search

CPC ..... B65D 83/38; B65D 83/14; B65D 1/0261
See application file for complete search history.

(56) References Cited

U.S. PATENT DOCUMENTS

| | | | | |
|---|---|---|---|---|
| 2,837,245 | A * | 6/1958 | Grebowiec | B65D 83/38 215/376 |
| 4,969,577 | A * | 11/1990 | Werding | B65D 83/14 141/3 |
| 5,152,411 | A * | 10/1992 | Pope | B65D 23/00 215/381 |
| 5,265,765 | A | 11/1993 | Maier | |
| D343,578 | S | 1/1994 | Dinand | |
| D344,677 | S | 3/1994 | Bareiss | |
| 5,427,258 | A | 6/1995 | Krishnakumar et al. | |
| 5,750,224 | A | 5/1998 | Quasters | |
| 5,780,130 | A | 7/1998 | Hansen et al. | |

(Continued)

FOREIGN PATENT DOCUMENTS

| | | |
|---|---|---|
| EP | 1 103 478 B1 | 12/2002 |
| EP | 1 126 083 B1 | 3/2010 |

(Continued)

OTHER PUBLICATIONS

Demirel, B. and F. Daver, "The Effects on the Properties of PET Bottles of Changes to Bottle-Base Geometry," Journal of Applied Polymer Science, Dec. 2009, 8 pages.

(Continued)

*Primary Examiner* — Jeffrey R Allen
*Assistant Examiner* — Jennifer Castriotta

(57) ABSTRACT

A plastic bottle for containing a product under pressure, such as a product to be dispensed as an aerosol. The plastic bottle includes a rounded base, a body extending about an axis of the bottle from the base towards a top end of the bottle, and a finish at the top end of the bottle. The base and the finish are configured to eliminate or to reduce undesirable properties such as bursting, splintering when dropped, and stress cracking.

19 Claims, 7 Drawing Sheets

(56) References Cited

U.S. PATENT DOCUMENTS

| | | | |
|---|---|---|---|
| 5,989,661 | A | 11/1999 | Krishnakumar et al. |
| 6,045,001 | A | 4/2000 | Seul |
| 6,060,140 | A | 5/2000 | Sprayberry et al. |
| D434,663 | S | 12/2000 | Jones et al. |
| 6,168,041 | B1 | 1/2001 | Berger et al. |
| D440,499 | S | 4/2001 | Bernard |
| D444,707 | S | 7/2001 | Endline |
| 6,548,133 | B2 | 4/2003 | Schmidt et al. |
| 6,585,123 | B1 | 7/2003 | Pedmo et al. |
| 6,659,298 | B2 | 12/2003 | Wong |
| D505,332 | S | 5/2005 | Zoller |
| 6,896,147 | B2 | 5/2005 | Trude |
| 7,028,866 | B2 | 4/2006 | Kunesh et al. |
| 7,201,291 | B2 | 4/2007 | Vigny et al. |
| 7,226,648 | B2 | 6/2007 | Al Ghatta et al. |
| D551,080 | S | 9/2007 | Pedmo et al. |
| 7,279,207 | B2 | 10/2007 | Darr |
| 7,303,087 | B2 | 12/2007 | Flashinski et al. |
| 7,402,333 | B2 | 7/2008 | Nakamura et al. |
| 7,445,826 | B2 | 11/2008 | Collette et al. |
| 7,451,886 | B2 | 11/2008 | Lisch et al. |
| 7,556,164 | B2 | 7/2009 | Tanaka et al. |
| 7,833,467 | B2 | 11/2010 | Suenaga et al. |
| D633,803 | S | 3/2011 | Murphy |
| 7,959,997 | B2 | 6/2011 | Takada et al. |
| 8,020,717 | B2 | 9/2011 | Patel |
| 8,053,009 | B2 | 11/2011 | Bourguignon et al. |
| D650,677 | S | 12/2011 | Wurster et al. |
| 8,123,056 | B2 | 2/2012 | Falzoni |
| D665,263 | S | 8/2012 | Sanghavi et al. |
| 8,247,049 | B2 | 8/2012 | Shi et al. |
| 8,389,085 | B2 | 3/2013 | Yanagimachi |
| 8,394,476 | B2 | 3/2013 | Hama et al. |
| 8,424,709 | B2 | 4/2013 | Boukobza |
| 8,507,063 | B2 | 8/2013 | Schneider et al. |
| 8,550,272 | B2 | 10/2013 | Yourist |
| D696,954 | S | 1/2014 | Carro |
| 8,662,332 | B2 | 3/2014 | Wurster et al. |
| 8,763,825 | B2 | 7/2014 | Wauters |
| 8,784,957 | B2 | 7/2014 | Komiya et al. |
| D715,150 | S | 10/2014 | Fedewa et al. |
| 8,935,904 | B2 | 1/2015 | Patel et al. |
| 8,956,707 | B2 | 2/2015 | Harlan |
| 8,980,390 | B2 | 3/2015 | Fuse et al. |
| D732,391 | S | 6/2015 | Toribio et al. |
| 9,233,771 | B2 | 1/2016 | Siegl |
| 9,327,860 | B2 | 5/2016 | Aoki et al. |
| 9,334,103 | B2 | 5/2016 | Soliman |
| 9,622,563 | B2 | 4/2017 | Collias et al. |
| 9,725,293 | B2 | 8/2017 | Quasters |
| 2004/0149781 | A1* | 8/2004 | Kunesh ..... B65D 83/38 222/402.1 |
| 2005/0242101 | A1 | 11/2005 | Skalitzky |
| 2009/0029900 | A1 | 1/2009 | Cetti et al. |
| 2009/0194561 | A1 | 8/2009 | Quasters |
| 2011/0108574 | A1* | 5/2011 | Nimmo ..... B65B 31/003 222/95 |
| 2012/0308689 | A1 | 12/2012 | Poulat et al. |
| 2013/0037580 | A1 | 2/2013 | Armstrong et al. |
| 2013/0216748 | A1 | 8/2013 | Siegl |
| 2013/0270295 | A1 | 10/2013 | Collias et al. |
| 2014/0209633 | A1* | 7/2014 | McDaniel ..... B29B 11/14 222/95 |
| 2015/0102071 | A1 | 4/2015 | Patel et al. |
| 2015/0158660 | A1 | 6/2015 | Soliman |
| 2015/0166211 | A1 | 6/2015 | Aoki et al. |

FOREIGN PATENT DOCUMENTS

| | | | |
|---|---|---|---|
| EP | 1 346 919 | B1 | 5/2010 |
| GB | 2 524 843 | A | 10/2015 |
| JP | 3920518 | B2 | 5/2007 |
| WO | 96/33062 | A1 | 10/1996 |
| WO | 98/06557 | A1 | 2/1998 |
| WO | 98/25752 | A1 | 6/1998 |
| WO | 98/29314 | A1 | 7/1998 |
| WO | 2008/125126 | A1 | 10/2008 |
| WO | 2011/151016 | A1 | 12/2011 |
| WO | 2012/061885 | A1 | 5/2012 |
| WO | 2014/104870 | A1 | 7/2014 |
| WO | 2014/116904 | A1 | 7/2014 |
| WO | 2015/032897 | A1 | 3/2015 |

OTHER PUBLICATIONS

Design Packaging for Perfumes by Gerresheimer Group; https://alepackdesigner.wordpress.com/category/packaging-for-cosmetics-and-perfumes, accessed Aug. 5, 2015, 1 page.

International Search Report and Written Opinion, issued in corresponding International Patent Application No. PCT/US2017/063827.

* cited by examiner

PLASTIC BOTTLE FOR A PRESSURIZED DISPENSING SYSTEM

BACKGROUND

Field of the Invention

Our invention generally relates to a pressurized dispensing system that includes a plastic bottle. Such a system can be used to dispense, for example, an aerosol spray. More specifically, our invention relates to a dispensing system that includes a plastic bottle for containing a product under pressure, with the bottle having a unique configuration that eliminates or reduces undesirable properties such as bursting, splintering when dropped, and stress cracking.

Related Art

Pressurized dispensing systems, such as systems used to dispense aerosol products, have conventionally included metallic (e.g., steel or aluminum) containers for containing the product under pressure before it is dispensed from the system. Examples of products that are dispensed with such systems include air fresheners, fabric fresheners, insect repellants, paints, body sprays, hair sprays, shoe or footwear spray products, whipped cream, and processed cheese. Recently, there has been increased interest in using plastic bottles as an alternative to metallic containers in pressurized dispensing systems because plastic bottles have several potential advantages. For example, plastic bottles may be easier and cheaper to manufacture than metallic containers, and plastic bottles can be made in a wider variety of interesting shapes than metallic containers. As another example, plastics bottles are generally easier to recycle than metallic containers.

In order to be sold as a commercial product, a pressurized aerosol dispensing system, including a system with a plastic bottle, must meet aerosol regulatory requirements, for example, U.S. Department of Transportation and European Aerosol Federation (FEA) safety regulations. Such regulations mandate that the system not burst at certain pressures, that the system does not fail upon impact in certain drop tests, and that when the system does burst, splinters of material are not created. Other regulations require that the materials of the container/bottle deform in a safe way when the system is heated to certain temperatures, e.g., that the system does not deform under certain conditions such that a valve at the top of the system is blown off.

Besides meeting safety regulations, to be commercially successful, a pressurized dispensing system must also be functional in other ways. For example, the system should be able to stand up-right on a level surface. Further, a plastic bottle used in a high pressure dispensing system needs to be resistant to stress crazing and cracking, as such visual defects may lead a user to think that the bottle is breaking. Stress crazing and cracking can also lead to product leaking from the bottle.

Several techniques have been developed in the art to make plastic bottles that satisfy the regulatory and functional requirements for use as a part of a pressurized dispensing system. An example of such a technique is using heat to induce crystallization in the plastic of certain regions of a bottle. Such a crystallized plastic bottle may be more resistant to some defects depending on the particular types of products that are used in the bottle. But, at the same time, inducing crystallization may cause several other problems, such as reduced impact resistance, increasing stress cracking, and causing discoloration in an otherwise transparent plastic bottle. In sum, it is difficult to achieve a plastic bottle having a combination of properties necessary and desirable for using the bottle in a pressurized dispensing system.

SUMMARY OF THE INVENTION

According to one aspect, our invention provides a plastic bottle for containing a product under pressure. The plastic bottle includes a rounded base at a bottom end of the bottle, a body extending about an axis of the bottle from the base towards a top end of the bottle, and a finish at a top end of the bottle, the finish extending about the axis of the bottle. The finish includes an inner surface having (i) a first section adjacent to the top end of bottle, the first section extending substantially perpendicular to the axis of the bottle, and (ii) a second section that is sloped inwards toward the axis of the bottle.

According to another aspect, our invention provides a plastic bottle for containing a product under pressure. The plastic bottle includes a rounded base at a bottom end of the bottle, with the base being thickest at a position adjacent to an axis of the bottle, and with the thickness decreasing at a rate of about 3.8 mm per mm along the base from the axis of the bottle. The bottle also includes a body extending about an axis of the bottle from the base towards a top end of the bottle, and a finish at a top end of the bottle, the finish extending about the axis of the bottle.

According to yet another aspect, our invention provides a plastic bottle for containing a product under pressure. The plastic bottle includes a finish at a top end of the bottle, with the finish extending about an axis of the bottle. A body of the bottle extends about the axis of the bottle from the finish towards a bottom end of the bottle. A rounded base is provided at the bottom end of the bottle, with the base being thickest at a position adjacent to the axis of the bottle. If the base is divided into three equal sections between a position corresponding to the axis of the bottle and a position adjacent to the body of the bottle, a first section adjacent to the axis of the bottle is about 20% of the total weight of the base, a second section adjacent to the first section is about 45% percent of the total weight of the base, and a third section adjacent to the body of the bottle is about 35% of the total weight of the base.

According to a further aspect, our invention provides a plastic bottle for containing a product under pressure. The plastic bottle includes a rounded base at a bottom end of the bottle, with the base being thickest at a position adjacent to an axis of the bottle, and with the thickness decreasing at a rate of about 3.8 mm per mm along the base from the axis of the bottle. The plastic bottle also includes a body extending about an axis of the bottle from the base towards a top end of the bottle. The plastic bottle further includes a finish at a top end of the bottle, with the finish extending about the axis of the bottle. The finish includes an inner surface that has a first section adjacent to the top end of bottle, with the first section extending substantially perpendicular to the axis of the bottle. The finish also includes a second section that is sloped inwards toward the axis of the bottle.

DETAILED DESCRIPTION OF THE INVENTION

Our invention generally relates to a pressurized dispensing system that includes a plastic bottle. More specifically, our invention relates to a dispensing system that includes a plastic bottle for containing a product under pressure, with the bottle having a unique configuration that eliminates or reduces undesirable effects such as bursting, failing when dropped, and stress cracking.

In the descriptions that follow, we will sometimes explain features of our invention in the specific context of a plastic bottle that is used in an aerosol dispensing system. Those skilled in the art will readily appreciate, however, that our invention is not limited to use with aerosol products. Rather, the pressurized dispensing systems that include a plastic bottle described herein could alternatively be used in conjunction with products other than aerosols. For example, the dispensing systems described herein might be used to dispense foam products such as shaving cream or soap, or used to dispense food products such as soda, whipped cream, processed cheese, and the like.

Figure 1:
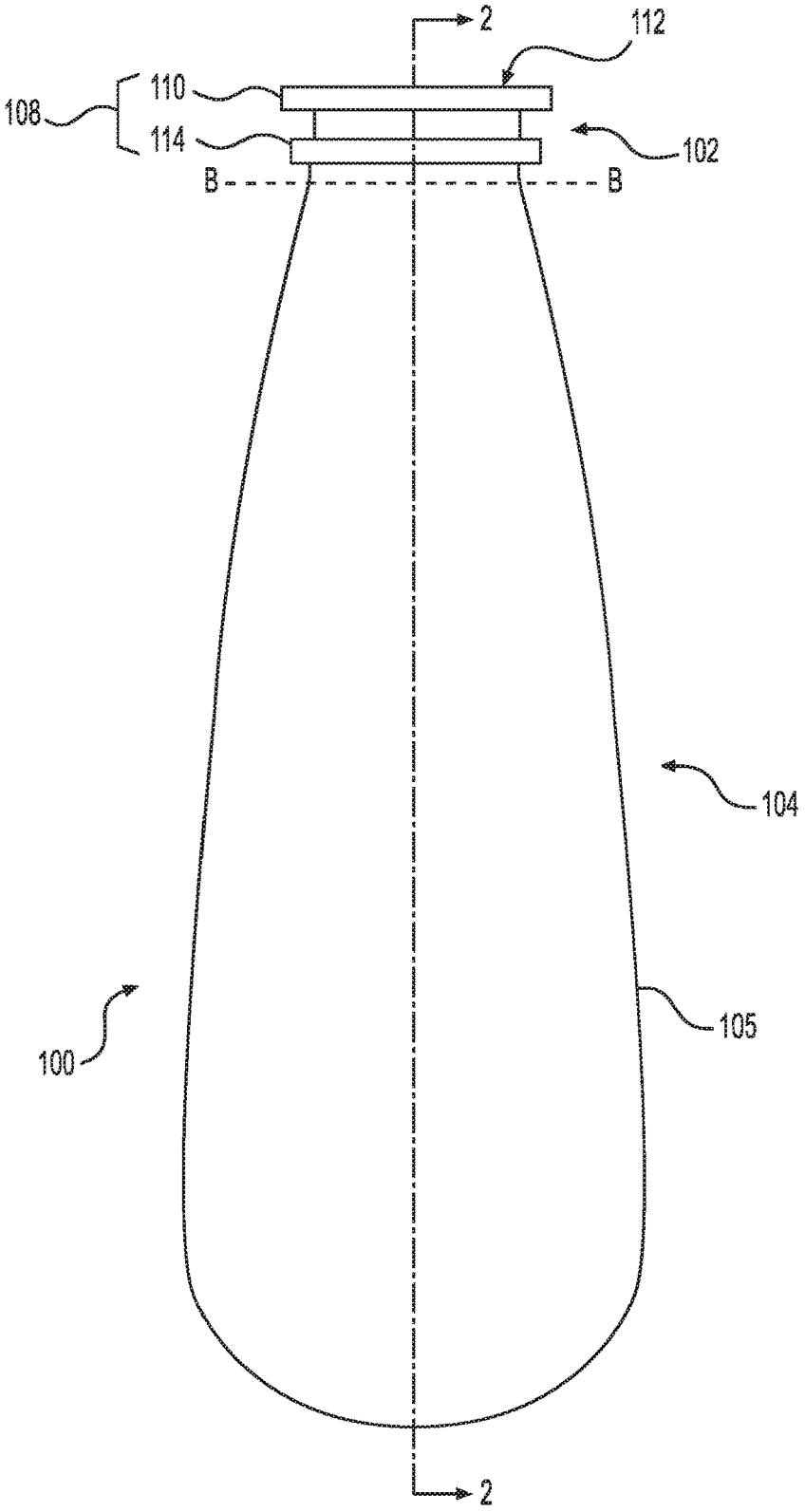
FIG. 1 is a side view of a bottle according to an embodiment of our invention.
Figure 2:
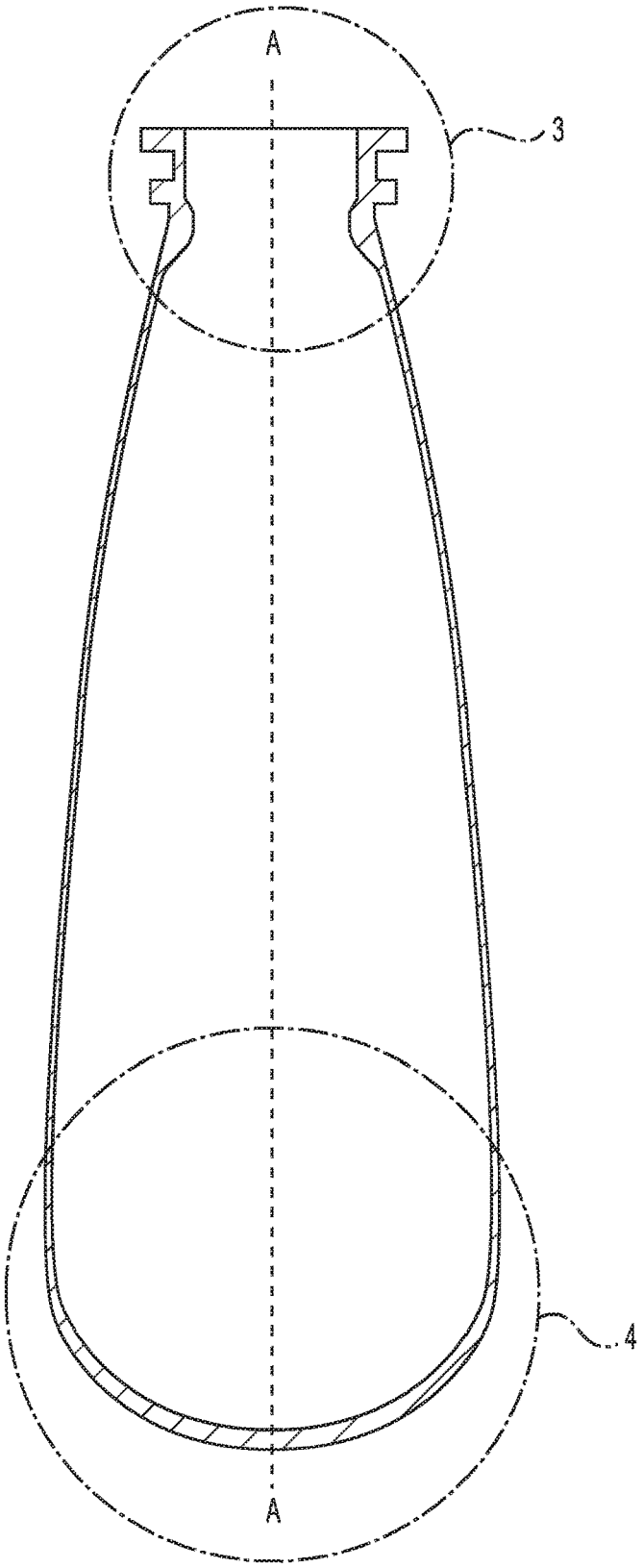
FIG. 2 is a cross-sectional view of the bottle shown in FIG. 1, as taken along line 2-2.

FIG. 1 shows a bottle 100 for use in a pressurized dispensing system according to an embodiment of our invention. For clarity, this figure does not include some of the components that would be a part of a complete dispensing system that includes the bottle 100. For example, a spray mechanism is not shown at the top of the bottle 100 in FIG. 1, nor does the bottle 100 include a structure at the bottom (e.g., a base cup) that allows the bottle 100 to stand up-right. A more complete description of a dispensing system using the bottle 100 will be described below.

The bottle 100 in this embodiment is made from a plastic material. As such, the bottle 100 may be formed using, for example, injection, compression, and/or blow molding techniques, which are well known in the art. In injection and blow molding processes, a plastic preform is first formed using injection molding. The plastic preform is subsequently heated and stretch blow molded into the final shape of the bottle 100. Some examples of such plastics include branched or linear PET, polycarbonate (PC), polyethylene naphthalate (PEN), nylon, polyethylene furanoate (PEF), polyolefins (PO) such as polyethylene (PE) and polypropylene (PP), and other polyesters, and blends thereof. It should be noted that the general shape, size, and proportions of the bottle 100 shown in FIG. 1 are merely exemplary. Indeed, one of the advantages of using plastic to form the bottle 100 is that the plastic may be molded into a wide variety of shapes and sizes.

The bottle 100 includes an upper end 102, a base 106, and a body 104 with a sidewall 105 between the upper end 102 and base 106. In this embodiment, the body 104 of the bottle 100 is round and extends about an axis A. The upper end 102 includes a finish 108 having a crimp ring 110 surrounding an opening 112 of the bottle 100. A valve (not shown) can be crimped to the crimp ring 110 in order to securely attach the valve to the bottle 100. The product contained in the bottle 100 can thereby be dispensed through the valve. The finish 108 also includes a transfer ring 114 positioned below the crimp ring 110. During a process for manufacturing the bottle 100, a preform of the bottle 100 may be gripped at the transfer ring 114 to transfer the preform between processing stations.

Note, the line B-B is shown at a position that generally demarcates the finish 108 and the body 104. In an injection and stretch blow molding process of making the bottle 100, the line B-B also demarcates the parts of the bottle 100 that are stretched in the blow molding process (i.e., the body 104 and base 106), from the part that is formed in the injection molding process but not reshaped in the blow molding process (i.e., the finish 108). Further details of how the bottle 100 is stretched in the blow molding process will be described below in conjunction with a description of the preform used to make the bottle 100.

Notably, in embodiments of our invention, the bottle 100 is manufactured such that no crystallinity is intentionally induced by using heat setting during a stretch blow molding process in which the bottle 100 is formed. For example, in a process of manufacturing the bottle 100 involving an injection molding and stretch blow molding, there is no step, such as heating, that is conducted in order to intentionally increase the crystallinity in a region of the bottle—any crystallinity in the bottle 100 is merely the product of the injection molding and stretch blow molding. As such, the crystallinity in the plastic of the bottle 100 is kept low, particularly in the finish region 108 of the bottle 100, which is not subject to stretching in the blow molding process. In particular embodiments of our invention, the finish region has less than about 10% crystallinity in the finish region 108, less than about 25% crystallinity in the main body 104, and less than about 15% crystallinity in the base 106. Note, as used herein, crystallinity is determined in accordance with ASTM Standard D1505 such that:

$$\%\ \text{crystallinity}=[(ds-da)/(dc-da)]\times 100$$

where ds is the sample density in g/cm$^3$, da is the density of an amorphous film of 0% crystallinity (for PET, da is 1.333 g/cm$^3$), and dc is the density of the crystal calculated from unit cell parameters (for PET, dc is 1.455 g/cm$^3$).

Figure 3:
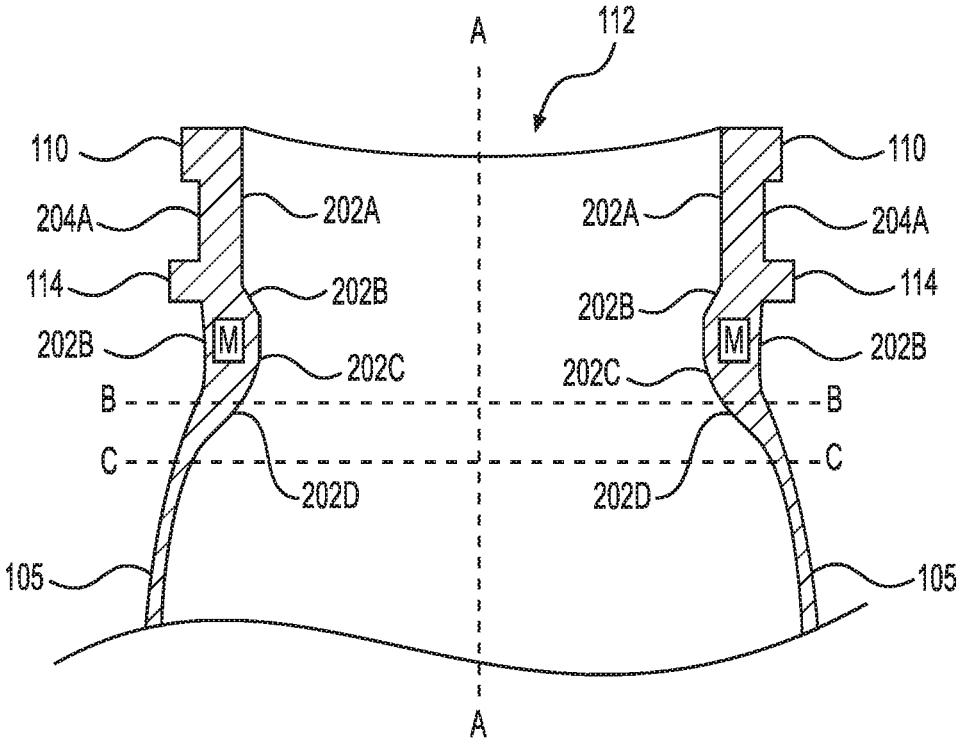
FIG. 3 is a detailed view of the top end of the cross section of the bottle shown in FIG. 2.

FIG. 3 is a cross-sectional view of the top end of the bottle 100. As can be seen in FIG. 3, a first section 202A of the inner surface of the bottle 100 extends downward from the opening 112. This first section 202A is substantially parallel to the axis A until a position that is generally adjacent to the transfer ring 114. At that position, a second section 202B of the inner surface in the finish 108 region is sloped inward towards the axis A of the bottle 100, with the second section 202B continuing below the transfer ring 114. After the second section 202B, the inner surface has a third section 202C that is sloped outward from the axis A-A. The third section 202C continues on to a fourth section 202D of the inner surface that is below the line B-B into the section of the bottle corresponding to the body 104. The fourth section 202D then continues to positions on the bottle 100 denoted with the line C-C in FIG. 3. In the fourth section 202D, the thickness of the bottle 100 decreases to the extent that, at the points corresponding to the line C-C, the bottle 100 has a thickness that is substantially constant through the sidewall 105 of body 104 until the base 106 is reached. It should be noted that a diameter from the axis A-A to the sections 204A and 204B of the outer surface of the bottle above and below the transfer ring 114 is about the same. As such, the sections of the finish 102 that include the inner surface sections

202B, 202C, and 202D are thicker compared to a configuration wherein the inner surface section 202A continued in parallel with the axis A-A through the entire neck finish 102. That is, the bottle 100 includes additional material in the section labeled M as compared to a standard bottle configuration.

We have found that the additional material in section M of the bottle 100 surprisingly improves performance of the bottle in different ways. A bottle having a configuration with additional material in the finish, as described above, had increased resistance to bulging when the bottle was pressurized and also had notably less stress cracking as compared to a bottle that did not include additional material in section M. It is also notable that, when a bottle was configured such that further additional material is also provided to an outer part of the finish 108 general corresponding to the positioning of section M in bottle 100, no significant improvement could be seen in the bottle's resistance to stress cracking. An example of a plastic bottle having additional material provided to an outer part of the finish 108 can be seen in U.S. Pat. No. 7,303,087 B2. That patent describes a bottle designed to reduce deformation by providing reinforcement to the neck and shoulder regions of a plastic bottle, the reinforcement being achieved by providing an increased thickness of the wall in a direction toward the outside of the bottle. Our invention is different in that, instead of providing the additional material on an outer part of the bottle, the additional material is effectively provided to an inner part of the bottle, that is, with a part of the inner surface of the bottle 100 in the finish region 102 and main body portion 104 being sloped inward, as described above.

We have also found that particular ratios in the weight of material relative to the length from just below the transfer ring 114 to the position where the regular sidewall 105 thickness begins (which is denoted by the line C-C in FIG. 3) results in the bottle 100 having outstanding properties. Specifically, in an embodiment of our invention, the bottle 100 has about 0.25 grams of material per millimeter of length in the distance from just below the transfer ring 144 to the positions where the regular sidewall 105 thickness begins. In order to achieve this ratio of weight to length, the material making up the bottle 100 can be provided in a distribution so that the sections 202B, 202C, and 202D are sloped, as described above. However, other distributions can be used while still achieving the 0.25 g/mm ratio of weight to length. When using sloped surfaces, another aspect of our invention is that the slope of the inner surface in sections 202C and 202D relative to the outer surface is about 0.35 mm/mm. With such distributions of the material, the bottle is provided with outstanding stress cracking in the finish 108 region. Further, bottles having such material distributions have synergistic properties when the bottles are provided with the particular base configurations, as discussed below.

In a particular embodiment of our invention, the bottle 100 is configured with a thickness of about 3.75 mm at the beginning of the section 202B, and slopes to a maximum thickness of about 2.85 mm at about 1 mm below the transfer ring 114. The bottle thickness then decreases to a thickness of about 0.80 mm at the points about 7 mm below the crimp ring. And, when the bottle has such dimensions and is made from PET, the bottle is provided with about 1.80 g of material in the length from just below the transfer ring to the points about 7 mm below the crimp ring.

Figure 4:
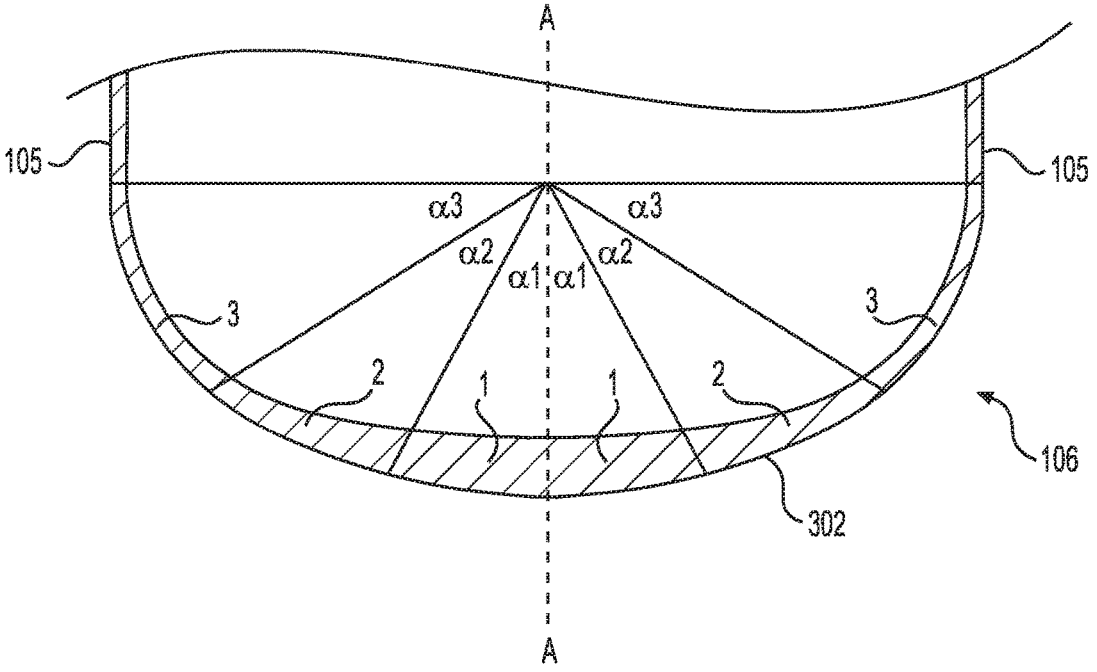
FIG. 4 is a detailed view of the lower end of the cross section of the bottle shown in FIG. 2.
Figure 5:
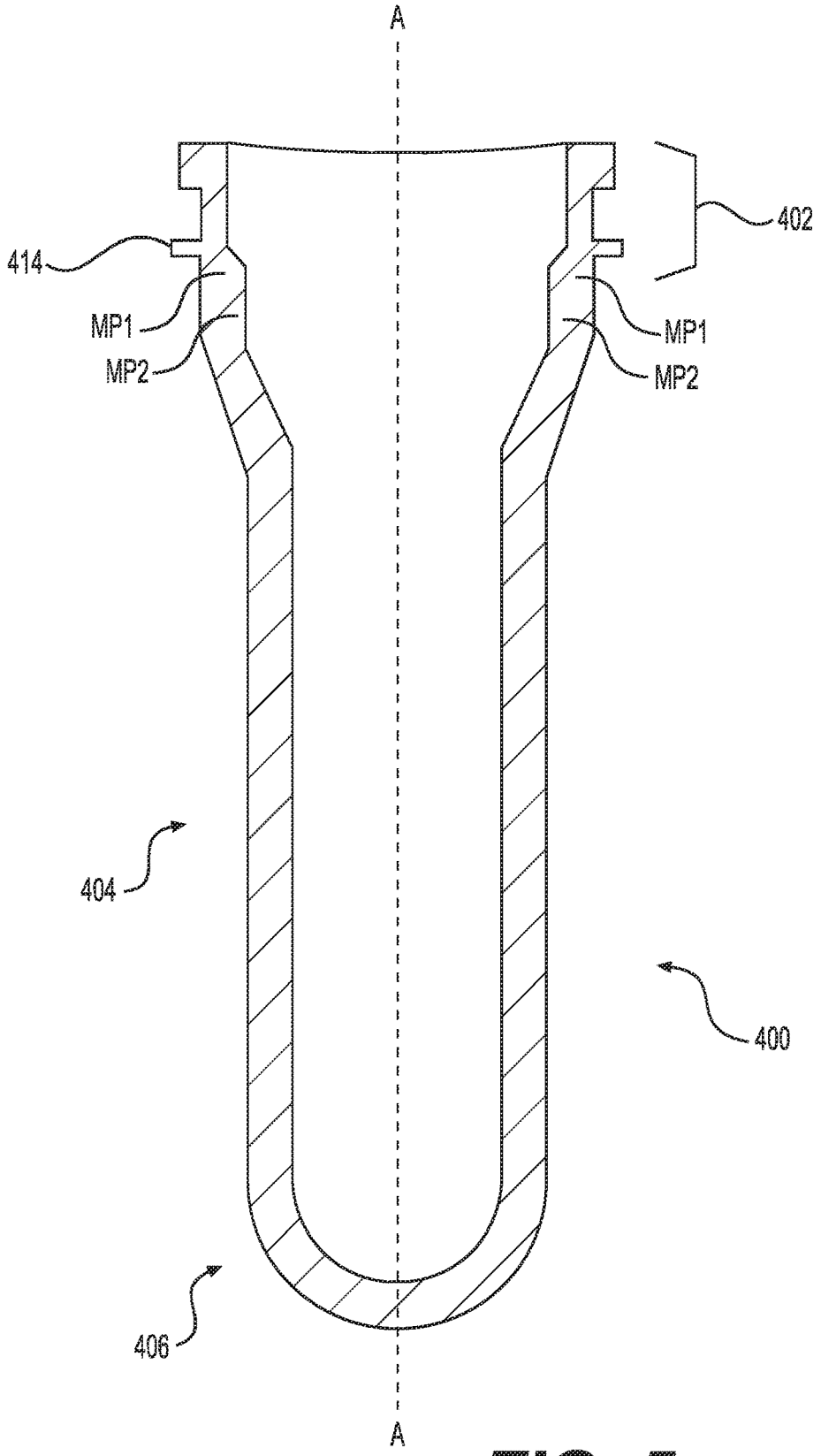
FIG. 5 is a cross-sectional view of a preform for making the bottle shown in FIG. 1.

FIG. 4 is a cross-sectional view of the base 106 of the bottle 100. The base surface 302 of the bottle 100 has a generally elliptical shape. In the development of our invention, we found that bottle configurations having a rounded shape performed much better than base shapes that are specifically designed to allow the bottle to stand-up right. For example, base shapes configured to provide feet on the bottle often bulged outward when test bottles were filled with a product and heated. Further, bottles with self-standing bases often failed drop testing, with the shaped bases bursting on impact. Even further, the self-standing bases added stress points around the base when the bottles were pressurized and stress cracking was often rampant. All of these problems are greatly reduced, if not completely eliminated, when using rounded bases, an example of which is shown in FIG. 4. In order to enable a rounded base bottle to stand up-right, a base cup, for example, may be attached to the bottom end (base) 106 of the bottle 100. Details of a base cup and how the base cup can be attached to the bottle 100 can be found in commonly-assigned U.S. patent application Ser. No. 15/166,337, which is hereby incorporated by reference in its entirety.

In the cross section shown in FIG. 4, the base 106 is divided into three equal sections—labeled 1, 2, and 3—between the axis A-A and the end of the base (adjacent to the sidewall 105 of the body 104). That is, the section labeled 1 includes the part of the base 106 between the axis A and a position corresponding to angle $\alpha$1 that is 30° from the axis A, the section labeled 2 includes the part of the base 106 between the section labeled 1 and a position corresponding to angle $\alpha$2 that is 60° from the axis A, and the section labeled 3 includes the part of the base between the section labeled 2 and a position corresponding to angle $\alpha$3 that is 90° from the axis A. The base of the bottle 100 is thickest at Section 1, i.e., the part of the base 106 that is closest to the axis A of the bottle. From this part, the thickness of the base 106 gradually decreases in sections 2 and 3. We have found that such a gradual reduction in thickness of the base 106 is closely related to performance of the bottle in terms of resistant to failure in drop tests and resistance to stress cracking. Moreover, we have found that when the thickness of the base 106 decreases at a rate of about 3.8 mm per mm along the base 106, a surprisingly high resistance to failure in drop tests and surprisingly high resistance to stress cracking can be achieved.

Moreover, we found that surprisingly better performance can be obtained when the sections 1-3 have certain relative parameters. Specifically, in an embodiment of our invention, the section 1 accounts for about 10% of the total outer surface area of the base 106 and about 20% of the weight of the base 106, the section 2 accounts for about 30% of the total outer surface area of the base 106 and about 45% percent of the weight of the base 106, and the section 3 accounts for about 60% of the total outer surface area and about 35% of the total weight of the base 106. With these parameters, the base 106 has considerable resistance to failure in drop tests and resistance to stress cracking as compared to other configurations.

Another aspect of the base 106 is relative consistency of the base to withstand impact in different bottles having configurations such as that of bottle 100. In this regard, the maximum force that the base 106 can withstand upon impact may vary for any given bottle design. This is because of many factors that may influence the actual impact resistance of a given bottle, such as the exact processing conditions that were present during the manufacture of the particular bottle. Nevertheless, there is a minimum impact force that a bottle having a particular design must be able to withstand without breaking, for example, to meet the regulations generally discussed above. It is also beneficial if the ability of the base of the bottle to withstand an impact force does not widely vary for a particular bottle design, as this provides assurance as to the reliability of the bottle design.

One way to determine the impact force that will cause a base to break in a given plastic bottle design is through a high speed puncture test using load and displacement sensors. Such tests can be conducted, for example, using a falling dart test, wherein the load cell inside the dart records the force and energy required to fracture the bases of the test bottles. When conducting such tests on bottles according to our invention (as described herein), and when comparing the results to tests with other plastic bottles having different designs, we found that the bases in bottles according our invention all had a high resistance to impact as even the lowest measured forces at fracture of the bases were sufficient to allow the bottles to be used to contain pressurized products. We also found that the bases in the bottles according to our invention had a relatively narrow range between the minimum measured force and the maximum measured force that fractured the bases. Specifically, in a falling dart test in accordance with ASTM D3763, using a striker with (i) a capacity of 8.720 kN, (ii) a mass of 2.551 kg, (iii) a diameter of 12.7 mm, (iv) a velocity of 4.40 m/s, and (v) a working range of up to 1.453 kN, the bases in bottles made from PET with configurations according to our invention had a peak force at fracture of between about 450 N and about 700 N. The minimum force of about 450 N was greater than the minimum force found with other plastic bottles having different configurations. Further, the 250 N range between the minimum and maximum forces was narrower than the ranges for other plastic bottles having different configurations.

We believe that the configurations of the finish and the configurations of the base of the bottle described herein synergistically result in a bottle that meets the safety requirements discussed herein (e.g., resistant to bursting and not failing when dropped) while also greatly exceeding other functional requirements (e.g., resistant to stress cracking). For example, we have noted that when a plastic bottle does not include a rounded base with the configurations and features described herein, negative effects, such as increased stress cracking, can be seen in the finish of the bottle. As another example, we have also noted when too much additional material is added to outer portions of the finish, as described above, the cycle time increased during the process of making the bottle, which in turn had negative effects on the base of the bottle. It follows that our inventive configurations in the finish and base work together in order to achieve the outstanding performance of the bottle.

FIG. 4 is a cross-sectional view of a preform 400 that can be used to form the bottle 100. As is well known in the art, a preform 400 is an intermediate product in an injection and blow molding process, with the preform 400 being the injection molded product that is subjected to blow molding to form the final product. The preform 400 includes a finish section 402 that corresponds to the finish 102 of the bottle 100, a body section 404 that corresponds to the body of the bottle 100, and a base portion 406 that corresponds to the base 106 of the bottle 100. As discussed above, the finish portion 402 of the preform 400 is not altered during the blow molding process. Hence, the finish portion 402 of the preform 400 has the nearly the same configuration as the finish portion 102 of the bottle 100. The body portion 404 and base portion 406, however, are stretched into the final shapes of the body portion 104 and base portion 106 of the bottle 100.

The finish portion 402 of the preform 400 includes thickened material portions MP1 and MP2 that extend downward from the transfer ring 414. The thickened material portions MP1 and MP2 correspond to the additional material portion M of the bottle 100, as described above. The thickened material portion MP1 is in the finish portion 402 of the preform 400, and therefore has nearly the same configuration as the additional material portion M in the bottle 100. For example, the part of the thickened material portion MP1 slopes inward relative to the axis A of the preform 400 in same manner as the inner surface section 202B in the finish 102 of the bottle 100 slopes inward relative to the axis A of the bottle 100. On the other hand, the thickened material portion MP2 is positioned within the body portion of the 404 of the preform 400, and, thus, the thickened material portion MP2 is stretched during a blow molding process for making the bottle 100. The thickened material portion MP2 therefore has a different configuration than the corresponding part of the additional material portion M of the bottle 100.

Notably, because the preform 400 is configured to form a bottle with a rounded base, there are no steps in the base region 402 of the preform 400. Thus, the preform 400 has a reduced amount of material as compared to a preform that would be used to form a bottle with a non-rounded based (e.g., a bottle with feet for making the bottle stand up-right). The reduced amount of material allows for a comparatively reduced cycle time in the production of the bottle. And, with this reduction in cycle time, there is a reduction in crystallinity in the base of the bottle. As discussed above, crystallinity decreases impact resistance and increases stress cracking. The rounded base of the preform 400 is further beneficial in that there is limited interaction with the blow rod that is used to stretch the preform 400 in the blow molding process.

Figure 6:
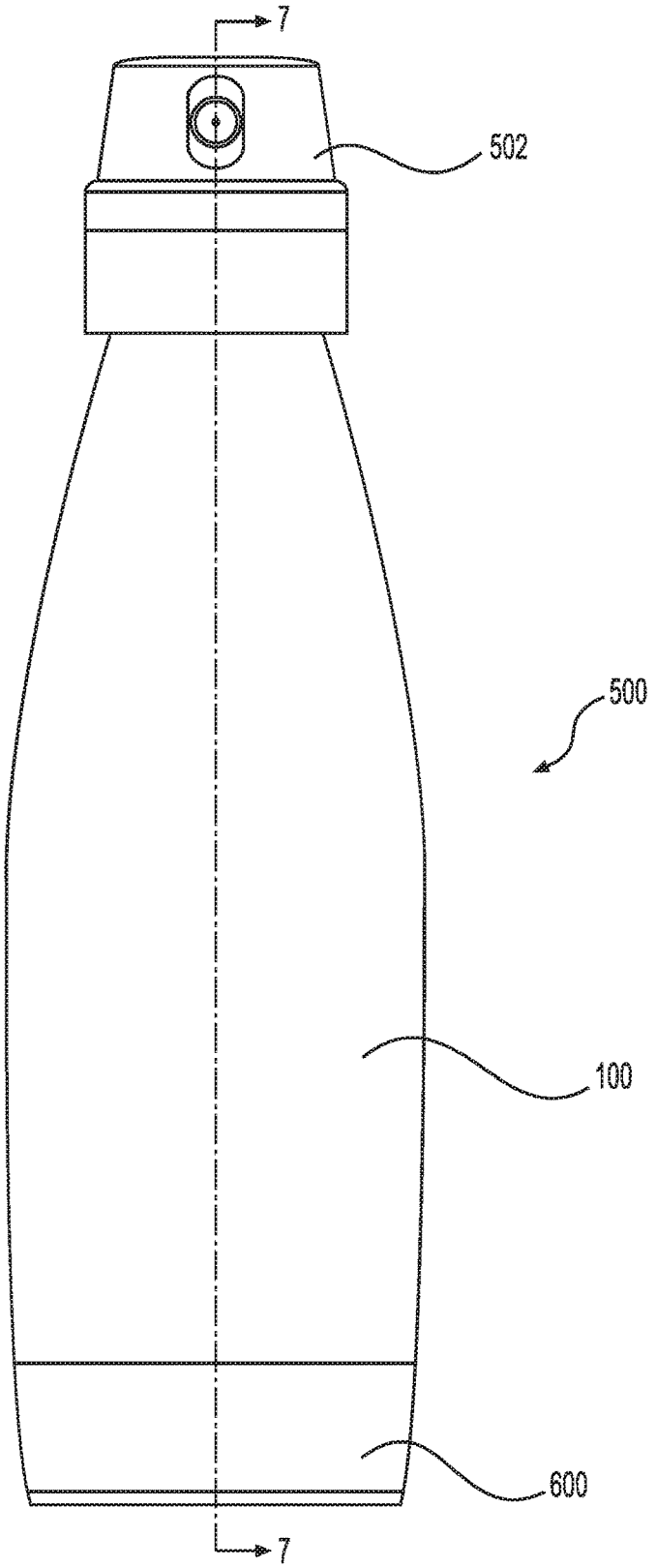
FIG. 6 is a side view of pressurized dispensing system according to an embodiment of our invention.
Figure 7:
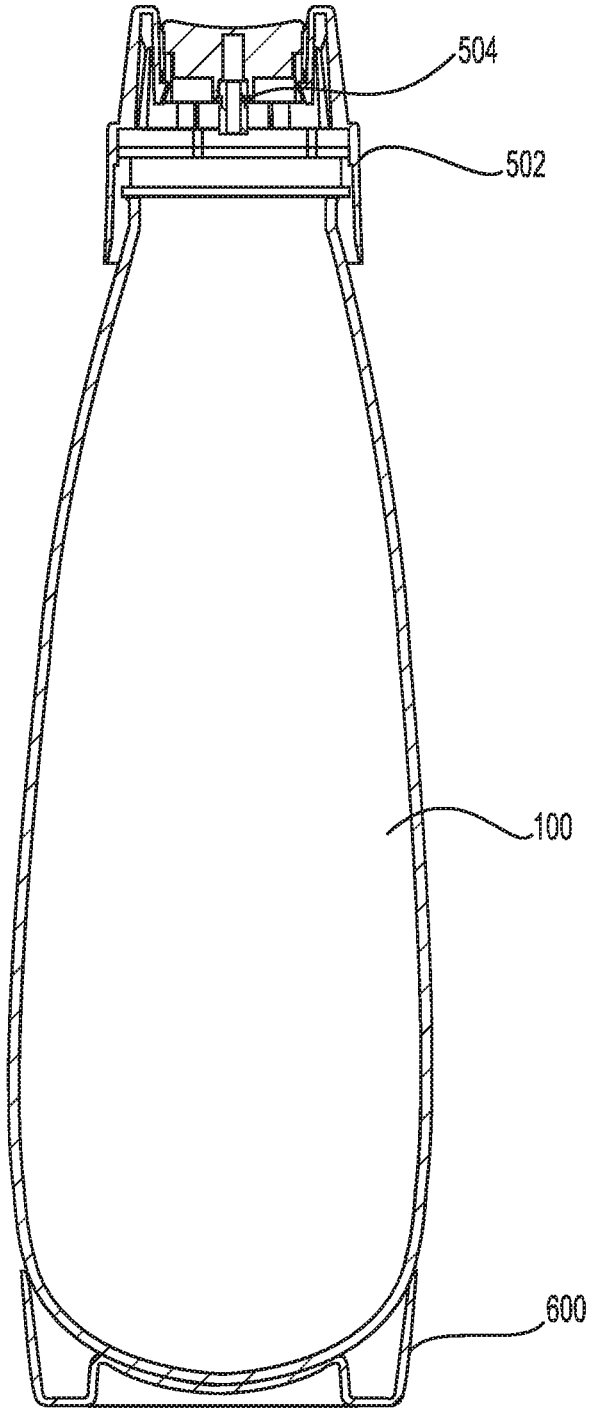
FIG. 7 is a cross-sectional view of a dispensing system shown in FIG. 5, as taken along line 7-7.

An example of a high-pressure dispensing system 500 using the plastic bottle 100 is shown in FIGS. 6 and 7. In the system 500, the rounded base 106 of the bottle 100 is attached to a base cup 600. The base cup 600 allows the system 500 to stand up-right on a flat surface despite the rounded base 106. At the top of the system 500 is a spray mechanism 502, which includes a valve 504. The pressurized product contained within the bottle 100 is dispensed through the spray mechanism 502. Although not shown, a cap may be provided over the spray mechanism 502. Those skilled in the art will recognize the wide variety of valves, spray mechanisms, and caps that could be used with a high-pressure dispensing system of the type described herein.

In a specific embodiment of our invention, the system 500 is used to dispense an air freshening composition. Examples of formulations for the air freshening composition can be found in commonly assigned U.S. patent application Ser. No. 15/094,542, which is hereby incorporated by reference in its entirety.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention described herein can be used in the commercial production of a pressurized dispensing system. Such pressurized dispensing systems have a wide variety of uses, for example, in the market of aerosol products.

We claim:

1. A plastic bottle for containing a product under pressure, the plastic bottle comprising:

(a) a rounded base at a bottom end of the bottle, the rounded base being convex towards the outside of the bottle;

(b) a body extending about an axis of the bottle from the base towards a top end of the bottle; and (c) a finish at a top end of the bottle, the finish extending about the axis of the bottle, the finish including a first ring extending outwardly from an outer surface of the finish and a second ring extending outwardly from the outer surface of the finish and positioned below the first ring, the finish also including an inner surface that includes (i) a first section extending substantially parallel to the axis of the bottle, and (ii) a second section below the first section, with the second section being sloped inwards and downwards toward the axis of the bottle, and with the second section extending from a position corresponding to the second ring to a position below the second ring, wherein the plastic bottle is configured such that the product can be dispensed as an aerosol.

2. The plastic bottle according to claim 1, wherein the inner surface includes a third section below the second section, with the third section sloping outwards from the axis of the bottle.

3. The plastic bottle according to claim 2, wherein a slope of at least a portion of the third section is about 0.35 mm/mm.

4. The plastic bottle according to claim 2, wherein at least a portion of the third section has a ratio of weight to length along the bottle of about 0.25 g/mm.

5. The plastic bottle according to claim 1, wherein the bottle is made from polyethylene terephthalate (PET).

6. A plastic bottle for containing a product under pressure, the plastic bottle comprising:

(a) a rounded base at a bottom end of the bottle, the rounded base being convex towards the outside of the bottle, and the base being thickest at a position including an axis of the bottle, with the thickness decreasing at a rate of about 3.8 mm per mm along the base from the axis of the bottle;

(b) a body extending about the axis of the bottle from the base towards a top end of the bottle; and (c) a finish at the top end of the bottle, the finish extending about the axis of the bottle, wherein the plastic bottle is configured such that the product can be dispensed as an aerosol.

7. The plastic bottle according to claim 6, wherein, in a falling dart test conducted in accordance with ASTM D3763, using a striker with (i) a capacity of 8.720 kN, (ii) a mass of 2.551 kg, (iii) a diameter of 12.7 mm, (iv) a velocity of 4.40 m/s, and (v) a working range of up to 1.453 kN, the base has a peak force at fracture of at least about 450 N.

8. The plastic bottle according to claim 7, wherein the peak force at fracture of the base is between about 450 N and about 700 N.

9. The plastic bottle according to claim 6, wherein the bottle is made from polyethylene terephthalate (PET).

10. A plastic bottle for containing a product under pressure, the plastic bottle comprising:

(a) a finish at a top end of the bottle, the finish extending about an axis of the bottle;

(b) a body extending about the axis of the bottle from the finish towards a bottom end of the bottle; and (c) a rounded base at the bottom end of the bottle, the rounded base being convex towards the outside of the bottle, and the base being thickest at a position including the axis of the bottle, wherein, if the base is divided into three equal sections between a position corresponding to the axis of the bottle and a position adjacent to the body of the bottle, a first section including the axis bottle is about 20% of the total weight of the base, a second section adjacent to the first section is about 45% of the total weight of the base, and a third section adjacent to the body of the bottle is about 35% of the total weight of the base, wherein the plastic bottle is configured such that the product can be dispensed as an aerosol.

11. The plastic bottle according to claim 10, wherein the first section corresponds to about 10% of the total outer surface area of the base, the second section corresponds to about 30% of the total outer surface area of the base, and the third section corresponds to about 60% of the total outer surface area of the base.

12. The plastic bottle according to claim 10, wherein, in a falling dart test conducted in accordance with ASTM D3763, using a striker with (i) a capacity of 8.720 kN, (ii) a mass of 2.551 kg, (iii) a diameter of 12.7 mm, (iv) a velocity of 4.40 m/s, and (v) a working range of up to 1.453 kN, the base has a peak force at fracture of at least about 450 N.

13. The plastic bottle according to claim 12, wherein the peak force at fracture of the base is between about 450 N and about 700 N.

14. The plastic bottle according to claim 10, wherein the bottle is made from polyethylene terephthalate (PET).

15. A plastic bottle for containing a product under pressure, the plastic bottle comprising:

(a) a rounded base at a bottom end of the bottle, the rounded base being convex towards the outside of the bottle, and the base being thickest at a position including an axis of the bottle, with the thickness decreasing at a rate of about 3.8 mm per mm along the base from the axis of the bottle;

(b) a body extending about the axis of the bottle from the base towards a top end of the bottle; and (c) a finish at a top end of the bottle, the finish extending about the axis of the bottle, the finish including an inner surface that includes (i) a first section adjacent to the top end of bottle, the first section extending substantially parallel to the axis of the bottle, and (ii) a second section below the first section, the second section being sloped inwards toward the axis of the bottle, wherein the plastic bottle is configured such that the product can be dispensed as an aerosol.

16. The plastic bottle according to claim 15, wherein the inner surface in the finish of the bottle includes a third section below the second section, with the third section sloping outwards from the axis of the bottle.

17. The plastic bottle according to claim 15, wherein the bottle further comprises a ring extending from an outer surface of the finish, and wherein the second section of the inner surface begins at a position corresponding to the ring.

18. The plastic bottle according to claim 15, wherein, if the base is divided into three equal sections between a position corresponding to the axis of the bottle and a position adjacent to the body of the bottle, a first section including the axis bottle is about 20% of the total weight of the base, a second section adjacent to the first section is about 45% of the total weight of the base, and a third section adjacent to the body of the bottle is about 35% of the total weight of the base.

19. The plastic bottle according to claim 15, wherein the bottle is made from polyethylene terephthalate (PET).

* * * * *